US005967028A

United States Patent [19]

Schomisch et al.

[11] Patent Number: 5,967,028

[45] Date of Patent: Oct. 19, 1999

[54] REFUSE MANAGEMENT SYSTEM AND METHOD

[75] Inventors: Donald R. Schomisch, Shelbyville; Stuart L. Sebright, Allegan, both of Mich.

[73] Assignee: Professional Management Disposal Systems (PMDS), L.L.C., Otsego, Mich.

[21] Appl. No.: 09/171,159

[22] PCT Filed: Apr. 29, 1997

[86] PCT No.: PCT/US97/06779

§ 371 Date: Oct. 28, 1998

§ 102(e) Date: Oct. 28, 1998

[87] PCT Pub. No.: WO97/40975

PCT Pub. Date: Nov. 6, 1997

Related U.S. Application Data

[60] Provisional application No. 60/016,442, Apr. 29, 1996.

[51] Int. Cl.[6] ..... B30B 15/26; B30B 9/30

[52] U.S. Cl. ..... 100/35; 100/50; 100/99; 100/229 A

[58] Field of Search ..... 100/35, 43, 48, 100/50, 52, 229 A

[56] References Cited

U.S. PATENT DOCUMENTS

| | | | |
|---|---|---|---|
| 4,643,087 | 2/1987 | Fenner et al. . | |
| 4,773,027 | 9/1988 | Neumann | 100/50 |
| 4,953,109 | 8/1990 | Burgis | 100/50 |
| 5,016,197 | 5/1991 | Neumann et al. . | |
| 5,173,866 | 12/1992 | Neumann et al. . | |
| 5,214,594 | 5/1993 | Tyler et al. . | |
| 5,299,142 | 3/1994 | Brown et al. . | |
| 5,299,493 | 4/1994 | Durbin et al. . | |
| 5,303,642 | 4/1994 | Durbin et al. . | |
| 5,558,013 | 9/1996 | Blackstone, Jr. | 100/35 |

FOREIGN PATENT DOCUMENTS 2 695 346 3/1994 France .

*Primary Examiner*—Stephen F. Gerrity
*Attorney, Agent, or Firm*—Flynn, Thiel, Boutell & Tanis, P.C.

[57] ABSTRACT

A refuse management system (10) has a refuse container (18) associated with a compactor (20) for compacting refuse in the container (18) at a local position, a local controller (26) for receiving and transmitting signals from the compactor, and a processor (14) at a remote position for receiving and processing signals from the local controller (26). A transmitter/receiver is positioned at each of the local and remote positions for establishing two-way communication between the local controller and the remote processor such that the controller and processor can each send and receive signals from each other. A local display (22, 90) is in communication with the controller (26) for displaying signals from the controller and signals received in the controller from the processor to thereby display container condition. A keypad (82) can be provided with the local display (22, 90) and controller for entering data into the controller and displaying data on the display. Preferably, the keypad has function keys (84) for entering and displaying data representative of system parameters and conditions, and scroll keys (86, 88) for scrolling through the da on the display. Methods of determining the condition of the compactor and refuse container are also disclosed.

22 Claims, 5 Drawing Sheets

REFUSE MANAGEMENT SYSTEM AND METHOD

CROSS-REFERENCE TO RELATED APPLICATION

This application claims the benefit of U.S. Provisional Application No. 60/016,442 filed on Apr. 29, 1996.

BACKGROUND OF THE INVENTION

1. Field of the Invention

This invention relates to refuse management systems, and more particularly to management systems for refuse compactors.

2. Description of the Related Art

Many large retail establishments own or lease refuse compactor systems. These systems usually include a trash compactor unit secured to a container. The container is separable from the compactor unit and can be loaded for transportation by truck to a landfill. Although containers vary in size, a container in common use can typically hold 40 cubic yards of compacted material. When the container is full, the retail establishment typically schedules a refuse hauling service to remove and empty the container. The hauling service sometimes exchanges an empty container for the full container at the retail establishment site to avoid interruption of the establishment's activities. Typically, an indicator light is located on the compactor to inform a user when the container is full. The light is illuminated in response to a pressure that meets or exceeds the preset maximum hydraulic pressure, the assumption being that the compactor cannot crush any further refuse into the container. However, the light can illuminate falsely when unusually hard refuse, such as wooden pallets, are deposited in the container. In addition, retail clerks responsible for loading the container and operating the compactor often fail to pay attention to the light when illuminated. Consequently, refuse backs up into storage areas of the retail establishment otherwise reserved for product shipments until a hauler can be scheduled to empty the container. This problem is augmented on weekends when many refuse hauling companies are closed. As a result, many establishments have the container emptied on a regular basis, whether or not the container is full. However, landfills often charge a standard rate for the size of the container, regardless of the actual amount of refuse disposed. Thus, the retail establishment is subject to additional unnecessary charges from both the hauling company and the landfill.

A refuse management system currently in use has attempted to overcome these problems by the provision of a programmable logic controller (PLC) installed at the compactor site. The PLC gathers, sorts, and stores information about the compactor's operation. A computer at a remote location can access the information stored in the PLC when prompted by a computer operator. The information can then be downloaded and printed into a report. The report is analyzed by a person knowledgeable in statistical analysis and the particular parameters of the compactor in review. The person must then determine when the container will be full and make arrangements with the hauling company to pick up the container. However, the information gathered by the PLC at the compactor site is not available to the end user. The end user does not know what decisions have been made and therefore cannot accurately schedule for compactor down time.

Another problem associated with the current system occurs frequently when the refuse container is removed for dumping. A proximity sensor normally senses the container's presence. When the container is pulled, the proximity sensor is actuated and some of the values stored in the PLC representative of the compactor system conditions, such as average pressure, amount of usage since last pull, etc., are reset. However, the compactor and its associated PLC are sometimes disconnected from their electrical source when the container is separated from the compactor, and reconnected after the empty container and compactor are rejoined. The proximity sensor in this circumstance does not generate a signal to reset the current values. As a result, the currently stored values are inaccurate and can be interpreted erroneously.

SUMMARY OF THE INVENTION

These and other problems of the prior art are overcome by the provision of a refuse management system having a local display for notifying an end user when the container is scheduled for hauling. According to one aspect of the invention, the local display is accessible from a remote location.

According to a further aspect of the invention, a method and system are provided for determining when the container has been pulled, even when the proximity sensor fails. The pressure of the compactor is monitored over a plurality of uses. When the average pressure falls below a predetermined lower limit, it is determined that the container was emptied, and a signal is generated to reset certain of the compactor parameters.

According to the invention, a method of determining the condition of a refuse container having a compactor associated therewith for compacting refuse in the container, includes operating the compactor to compact refuse in the container; measuring at least one pressure applied to the container by the compactor during at least one operation of the compactor; and calculating a first pressure percentage by dividing the measured pressure by a predetermined pressure limit. The first pressure percentage is reflective of the amount of used space in the refuse container.

According to another aspect of the invention, a second pressure percentage is calculated by subtracting the first pressure percentage from unity. The second pressure percentage is reflective of the amount of available space in the refuse container for holding more refuse.

According to an even further aspect of the invention, a plurality of pressures are measured during a corresponding plurality of compactor operations. An average pressure is determined from the plurality of pressures and then divided by the predetermined pressure limit to obtain the first pressure percentage. Preferably, the predetermined pressure limit is the maximum pressure applied by the compactor when the container is full.

The remaining times that the compactor can be actuated (the remaining usage) is obtained by determining a first usage of the compactor during a pull interval between an empty container condition and a full container condition when the container is pulled for dumping multiplying the second pressure percentage by the first usage. A time at which the container is full can also be forecasted by determining a plurality of second usages of the compactor for a corresponding plurality of sequential time intervals and comparing the remaining usage with at least one of the second usages. Preferably, the first usage is an average first usage taken over a plurality of pull intervals. The plurality of sequential time intervals defines a time group and each of the second usages is an average second usage taken over a plurality of time groups. In one embodiment, each time interval is a day and each time group is a week. In a further embodiment, each time interval is an hour and each time group is a work shift.

According to another aspect of the invention, a method for detecting container replacement in a refuse management system includes operating a compactor to compact refuse in the container; measuring a plurality of pressures applied to the container by the compactor during a plurality of corresponding compactor operations; calculating an average pressure for the plurality of measured pressures; comparing the average pressure with a low pressure set point; and determining that the container has been replaced if the average pressure is below the low pressure set point.

Before making a final determination of container replacement, the number of times that the compactor has been used since the last known container pull is compared with a minimum usage set point. If the compactor usage is above the minimum usage set point, it is determined that the container has been replaced.

According to an even further aspect of the invention, a refuse management system has a refuse container associated with a compactor for compacting refuse in the container at a local position, a local controller for receiving and transmitting signals from the compactor, and a processor at a remote position for receiving and processing signals from the local controller. A transmitter/receiver is positioned at each of the local and remote positions for establishing two-way communication between the local controller and the remote processor such that the controller and processor can each send and receive signals from each other. A local display is in communication with the controller for displaying signals from the controller and signals received in the controller from the processor to thereby display container condition. A keypad can be provided with the local display and controller for entering data into the controller and displaying data on the display. Preferably, the keypad has function keys for entering and displaying data representative of system parameters and conditions, and scroll keys for scrolling through the data on the display. The display can also include a warning light for indicating when at least one system parameter has been met or exceeded.

BRIEF DESCRIPTION OF THE DRAWINGS

The invention will now be described with reference to the drawings in which.

DETAILED DESCRIPTION OF THE PREFERRED EMBODIMENTS

Figure 1:
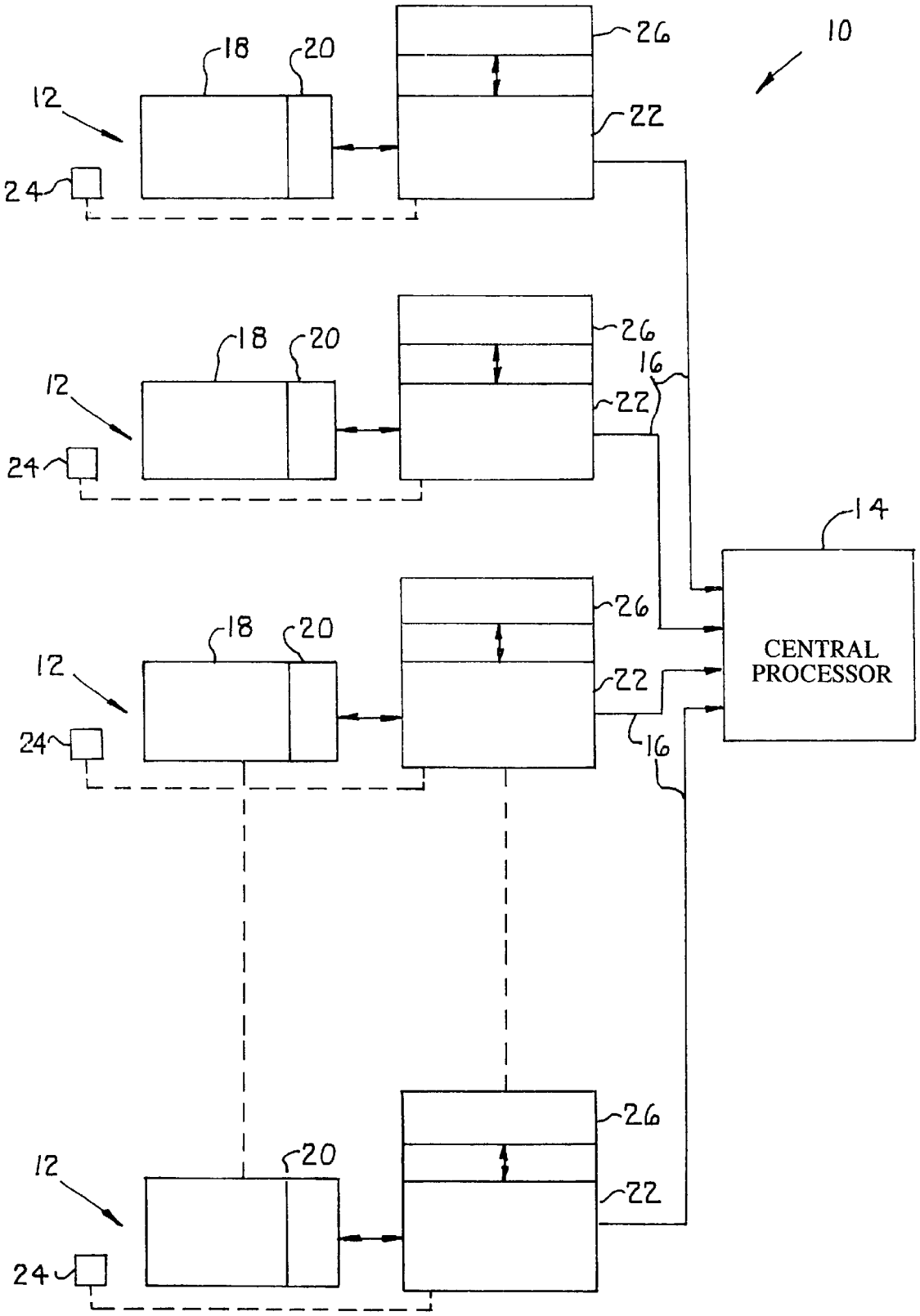
FIG. 1 is a diagrammatic representation of a plurality of refuse compactor systems according to the invention arranged for communication between a remote computer.

Referring now to FIG. 1, a refuse management system 10 includes a plurality of refuse compactor systems 12 arranged for communication between a remote computer 14 via phone lines 16. Each refuse compactor system 12 includes a refuse container 18 removably attached to a compactor 20. The compactor 20 is in communication with a programmable logic controller (PLC) or management computer 22. Signals representing compactor actuation and pressure are received, stored, and processed in the PLC 22. A proximity detector 24, such as an electro-optical sensor, sends a signal to the PLC 22 when the container is removed for emptying and informs the PLC when the container is present. The PLC generates and transmits a number of different parameters based on these signals when polled by a remote computer 14 that includes a central processor. One parameter generated is the container status, which indicates whether the container is present or missing based on a signal from proximity sensor 24. Another parameter generated is the current pressure P, which is measured from a pressure transducer (not shown) in the compactor hydraulic lines and is reflective of the current operation of the compactor. The current pressure is usually the residual pressure in the lines unless the compactor is running. Other parameters generated include the following:

(1) The average pressure $P_A$, which is the average of a plurality of pressure readings during compactor use. (Preferably, the pressure is averaged over ten readings; however, any number of readings can be used to generate the average);

(2) The last pressure $P_L$, which is the last pressure reading during compactor use;

(3) The high pressure $P_H$, which is the highest pressure recorded during compactor use since the container was removed;

(4) The time $T_O$ at which the container was removed for unloading; and (5) The average number of uses $U_A$ per day, hour, shift, etc. The average number of uses for a particular day $U_A$ is determined by dividing the number of compactor uses for the same day each week for the number of weeks recorded. For example, if compactor use for each Monday over a four-week period is 14, 18, 20, and 16, the average number of uses for a Monday would be 17. Similar calculations can be made for a particular hour or shift for each day.

A display 26 is in electrical communication with the PLC. The display 26 is capable of displaying information such as when the hauler has been ordered and when the container is full. This information is relayed via the PLC from the remote computer 14. Other parameters as described above may also be displayed. The remote computer can send messages, such as "Transportation ordered for (date)", "Container Full", etc., via the phone line 16 and PLC 22 to the display 26. The display 26 may be a light, such as a strobe light that is illuminated when transportation is being ordered and/or when a fault has occurred, or may be of the alpha-numeric, LCD, LED, or CRT type depending on what information is to be communicated.

Figure 2:
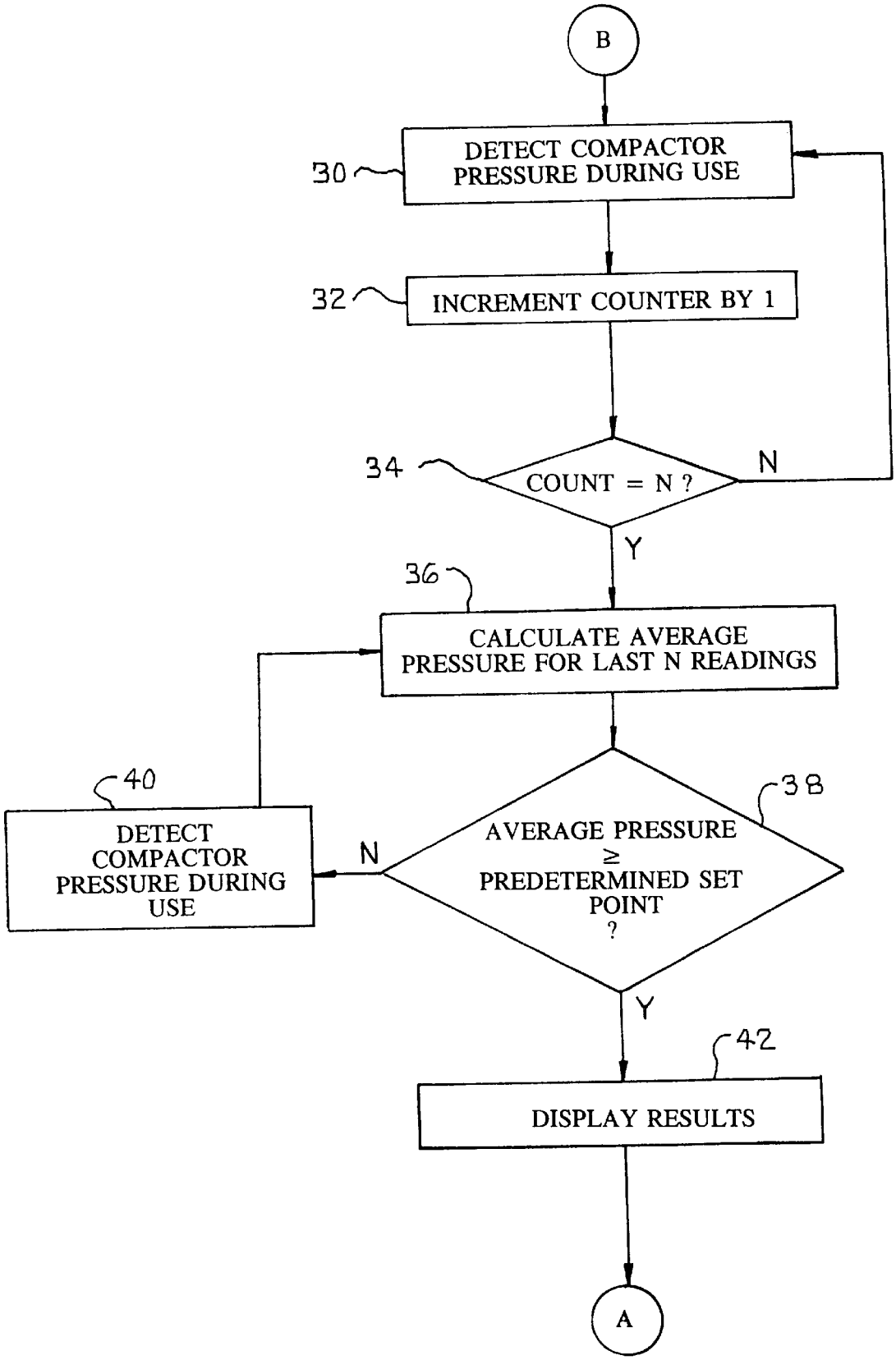
FIG. 2 is a block diagram illustrating a method according to the invention for determining the fullness of the refuse container.
Figure 4:
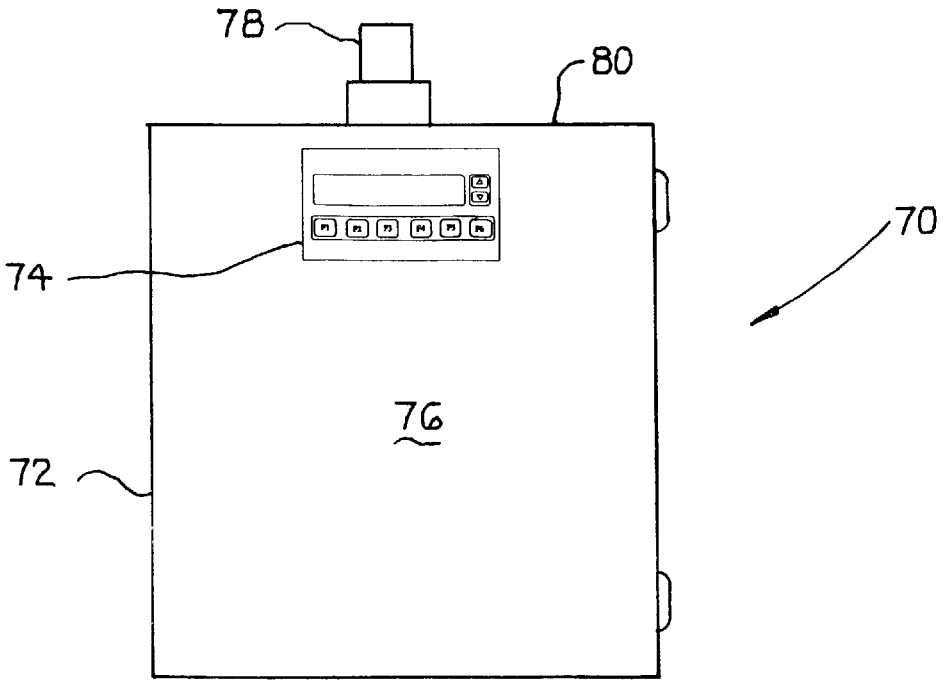
FIG. 4 is a side elevational view of a self-contained unit for monitoring and displaying various system parameters.
Figure 5:
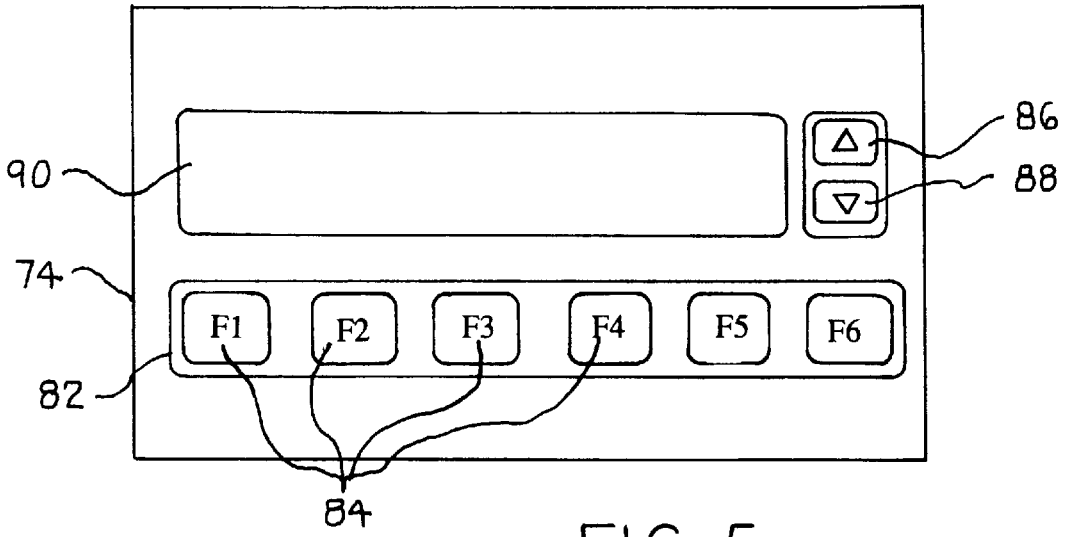
FIG. 5 is an enlarged view of the display and keypad of FIG. 4.

With reference now to FIG. 2, a method for determining when the refuse container is full will now be described. When the compactor 20 is actuated for compacting refuse in the container 18, a pressure signal $P_i$ is generated from the pressure transducer (not shown) within the compactor hydraulic lines and relayed to the PLC, as shown at block 30. If the container was recently emptied, a counter in the PLC is incremented by one as shown at block 32. If the count from the counter is not equal to the predetermined count n, then another pressure reading $P_{i+1}$ is taken, as shown at block 34. This process continues until the counter is equal to the predetermined count n. When the counter is equal to the predetermined count, an average pressure reading $P_A$ is calculated for the last n readings as shown at block 36. In a preferred embodiment, the average pressure $P_A$ is calculated for the last ten readings. In block 38, it is determined whether the average pressure is equal to or greater than a predetermined maximum operation pressure $P_M$, which for most compactors is in the range of about 1000 psi to about 2000 psi. This maximum operating pressure can be programmed into the PLC or computer through a computer keyboard (not shown) or a keypad (FIGS. 4, 5). As the container fills, the compactor must work increasingly harder. The amount of pressure sensed by the pressure transducer is reflective of how hard the compactor is working. Once the pressure reaches the maximum operating pressure $P_M$ the container is full and must be emptied. It is important to note that the pressure is averaged over a plurality of pressure measurements since any one pressure measurement may not be reflective of the amount of refuse in the container. For example, it is not uncommon for wooden pallets or other like materials to be thrown into the container. The compactor must work harder when actuated to compact these materials and therefore give a pressure reading that is not indicative of the container condition, albeit an accurate pressure reading. If it is determined in block 38 that the average pressure is less than the upper limit, the compactor pressure is again measured as shown at block 40. Since there are already n pressure measurements, the oldest pressure measurement is dropped, and a new average is calculated in block 36. If it is determined in block 38 that the average pressure is equal to or greater than the upper limit, the result is displayed on display 26 as shown at block 42. This result is also transmitted to the remote computer 14 when the PLC 22 is polled. When a hauler is ordered to empty the container, the display 26 is updated via the remote computer and PLC to relay this status to the end user. This information can be relayed not only to a local display or warning light, but also by fax, telephone, pager, etc., to the end user or other person.

Figure 2A:
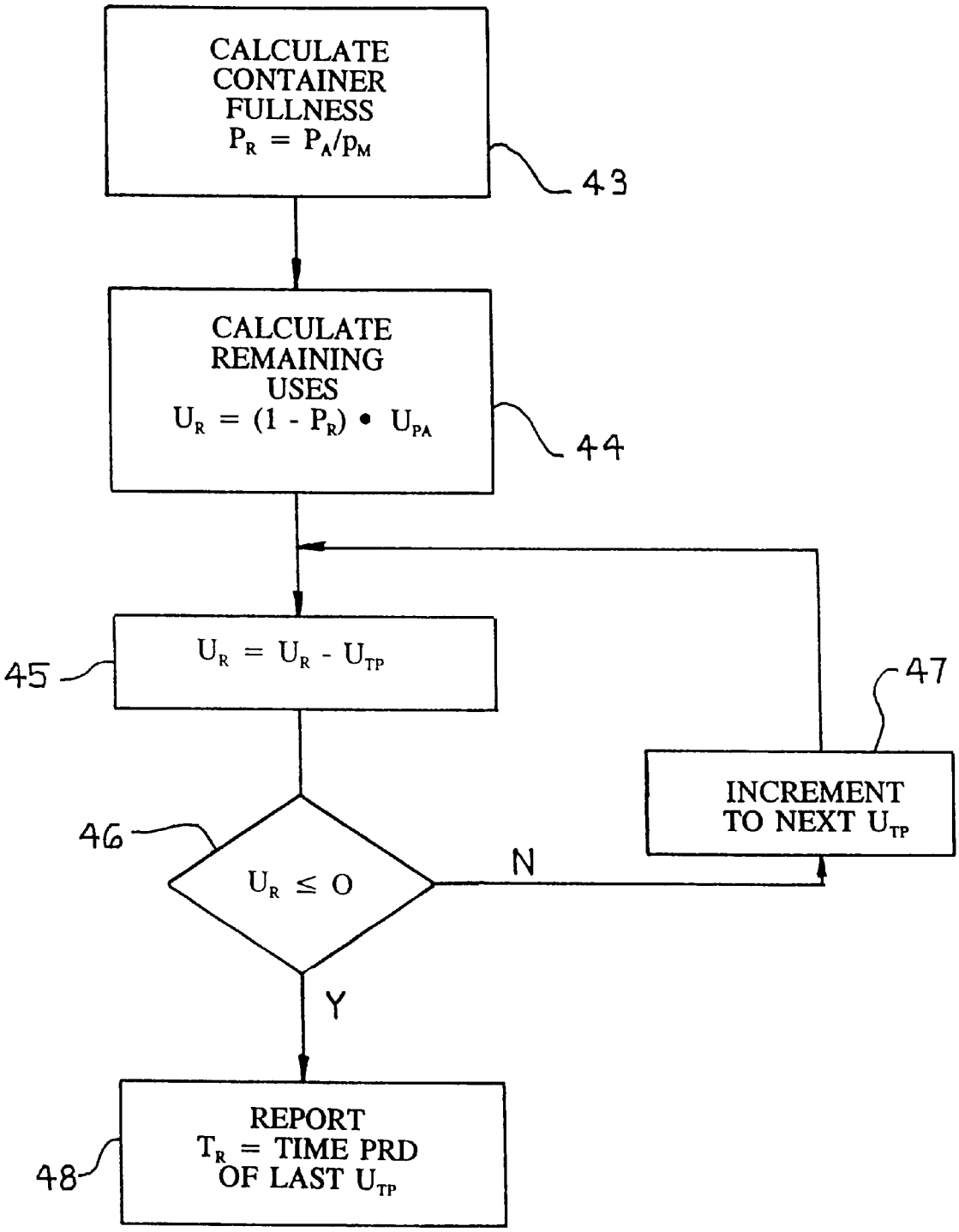
FIG. 2A is a block diagram of a method for predicting when the refuse contained will be full.

In addition to notifying the end users and haulers when the container is full, the system 12 projects the time at which the container 18 will be full so that service can be scheduled in advance as shown in FIG. 2A. In order to project when the container will be full, the average pressure $P_A$ calculated from the last n pressure measurements is divided by the maximum operating pressure $P_M$ of the compactor to give the pressure percentage $P_R$, block 43. This percentage $P_R$ is then subtracted from one (1) and the remainder is multiplied by the pull average usage $U_{PA}$ that the compactor is used between container pulls to give a number of remaining uses $U_R$, on average, before the container is full, block 44. The pull average usage $U_{PA}$ is equal to the total number of times that the compactor is used divided by the total number of container pulls since installation of the system. When the system is first installed, $U_{PA}$ can be estimated until the container is pulled for the first time. The pull average usage $U_{PA}$, becomes increasingly accurate over several pull cycles, but may continuously change, due to inconsistent use between pulls by end users. The amount of remaining time $T_R$ (expressed in days, hours, etc.) can then be calculated by subtracting the summation of an average usage $U_{TP}$, for each time period from the remaining number of uses $U_R$, blocks 45, 46 and 47. For example, in a compactor having a maximum operating pressure $P_M$ of 1600 psi and an average usage $U_A$ of 150 times per pull, and at the end of the day an average pressure $P_A$ of 1400 psi is recorded, the total number of remaining compactor uses $U_R$ would be (1−1400÷1600)·150=19. Thus, approximately 19 uses on average, remain before the compactor is full. If the following three days each have an average usage $U_{TP}$ of 10, 7 and 9 times, respectively, the container will be full on the third day after operating the compactor only one or two times. The computer at the remote location or the local PLC may then send this information to the display 26, a facsimile machine, pager, etc., indicating the current amount of uses remaining, the time remaining until the container is full, the scheduled time for servicing the container, block 48. This feature advantageously permits the end user to schedule around the container removal to thereby avoid or reduce any inconvenience.

The average pressure $P_A$ can also be used to estimate the amount of used and unused space in the container. As the container fills, the compactor must work harder to compress the refuse material. The pressure in the compactor hydraulic lines is reflective of how hard the compactor is working, and can thus be used as an accurate determination of how much compacted refuse is in the container The amount or percentage of used space in the container is determined by dividing the average pressure $P_A$ by the maximum operating pressure $P_M$ to give the pressure percentage $P_R$. The pressure percentage $P_R$ is reflective of the amount of used space in the container and can be displayed at both the local and remote locations. The amount of remaining space in the container can be determined by subtracting the pressure percentage $P_R$ from one (1).

Figure 3:
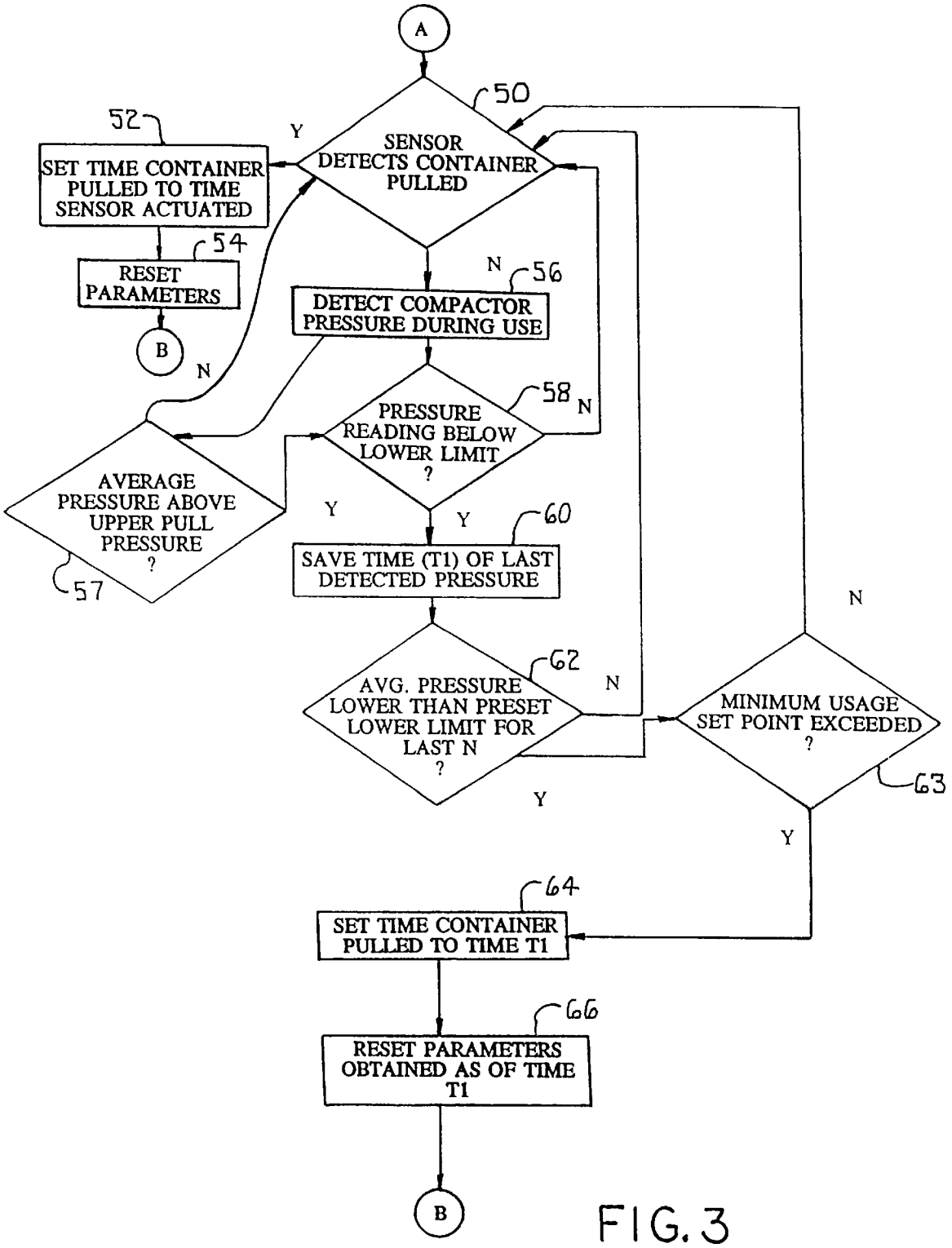
FIG. 3 is a block diagram illustrating a method according to the invention for determining if the refuse container has been removed.

Referring now to FIG. 3, a method for determining if the container has been removed will now be described. Once the hauler has been scheduled, or at any other predetermined time, it is determined at block 50 whether the proximity sensor 24 has been actuated. Actuation of the proximity sensor 24 is reflective of container removal. Once the sensor 24 has been actuated, the time that the container was removed is set to the time of sensor actuation as shown at block 52. Certain of the parameters are then reset at block 54. These parameters include the current pressure reading P, average pressure calculated $P_A$, last pressure $P_L$, high pressure $P_H$ since container pulled, and the pressure reading counter. The pressure is again monitored during use and the method in FIG. 2 is again repeated.

If, however, the sensor at block 50 was not actuated, the compactor pressure during use is again measured as shown at block 56. At block 57, it is then determined if the average pressure $P_A$ is above a predetermined upper pull set point $P_{UP}$, which is preferably about midway between the predetermined upper limit $P_M$ and a predetermined lower pull or "no loads" set point $P_{LP}$. For most compactor systems, this upper pull set point $P_{UP}$ will be in the range of about 500 to 800 p.s.i. Of course, other values between the lower pull set point $P_{LP}$ and upper limit $P_M$ can be entered into the PLC or computer. If the average pressure reading $P_A$ is below the upper pull set point $P_{UP}$, it is concluded that the container has not been pulled, and the container is again monitored at block 50 At block 58, it is then determined if the last pressure measurement is below the lower pull set point $P_{LP}$. As described above, when the container is empty or near empty, the compactor is not required to work hard. The amount of pressure sensed by the pressure transducer is reflective of how hard the compactor is working. Once the pressure is below the lower pull set point $P_{LP}$, there exists the possibility that the container may have been removed, emptied, and replaced without being detected by the proximity sensor 24. A number of different factors may prohibit the sensor 24 from actuating. For example, the sensor may be dysfunctional or improperly installed. More often, the PLC that monitors and displays the compactor condition is electrically connected to the compactor power supply. The compactor and its associated PLC are sometimes disconnected from the electrical source when the container is separated from the compactor, and reconnected after the empty container and compactor are rejoined. An end user or truck driver may unwittingly disconnect the electrical source, reasoning that an impaired compactor would be safer while detached from the container. In any event, the proximity sensor under these circumstances does not generate a signal to reset the current values. As a result, the current values are not reflective of the current container condition and can therefore be interpreted erroneously.

If the last pressure reading is not below the lower pull set point $P_{LP}$ at block 58, it can be fairly assumed that the container has not yet been removed and emptied. The PLC waits until the sensor 24 is actuated or until the compactor 20 is used again at block 50.

Once it has been determined that the last pressure reading is below the preset lower limit $P_{LP}$, the time at which the last detected pressure was measured is saved, as shown at block 60. It is then determined at block 62 if the average pressure $P_A$ for the last n readings is lower than the preset lower limit. If not, the PLC waits unit the sensor 24 is actuated or until the compactor 20 is used at block 50. It is important to note that the pressure is averaged over a plurality of pressure measurement since any one pressure measurement may not be reflective of the amount of refuse in the container. For example, assuming that the container has not yet been emptied, a low pressure measurement may be the result of actuating the compactor without adding additional refuse to the container. Since the refuse in the container is already compacted, the compactor does not work as hard. If, after n pressure measurements, the average pressure drops below the preset lower limit, it is a good indication that the container had been previously pulled without detection. As a precautionary measure, it is determined in block 63 if a minimum usage set point $U_M$ has been exceeded. The minimum usage set point $U_M$ is a number that can be entered into the PLC that is reflective of the number of times that the compactor is actuated from an empty container condition to a full container condition. This number can be accurately determined over several container loading and dumping cycles. If the minimum usage set point $U_M$ is not exceeded, the sensor again detects if the container is pulled at block 50. If $U_M$ is exceeded, the saved time of the first pressure reading to drop below the preset lower limit $P_{LP}$ is used at block 64 to set the time at which the container was removed. Certain of the parameters are then reset at block 66 as of the saved time. These parameters include the current pressure reading, average pressure calculated $P_A$, last pressure $P_L$, high pressure $P_H$ since container pulled, and the pressure reading counter. The pressure is again monitored during use and the method in FIG. 2 is again repeated.

Referring now to FIGS. 4 and 5, a self-contained unit 70 that can be installed on or near the compactor includes a PLC of the type heretofore described and a display module 74. A modem is also provided in the unit 70 for communication between the unit 70 and the remote computer. Alternatively, the modem is unnecessary when the unit is to be solely operated and controlled locally. The unit 70 includes a housing 72 with a data entry and display module 74 mounted to a front surface 76 thereof. A warning strobe light 78 is mounted to a top surface 80 of the housing.

With particular reference now to FIG. 5, the data entry/display module 74 comprises a keypad 82 having a plurality of function keys 84 (F1–F6), an up key 86, and a down key 88. A display 90 of the LED or LCD type is controlled by the microcomputer based on information received from the compactor and function keys. The F1 key functions as an "Enter" key that is pressed after inputting information into the module 74 through the keypad. The F2 key functions as an event and fault log key to display the current conditions within the compactor. When the strobe light is flashing, the display will show the event or fault associated with the flashing. The F3 key, when pressed, causes the display to show what time the container was pulled for dumping, how many times the compactor has been actuated since the last pull of the container, and the average pressure in the container during the last 10 uses. The F4 key is a security key that is pressed before entering a code. The code is entered by pressing a combination of function keys and/or the up and down keys in a particular sequence. In this manner, the user can gain access to and change the preset pressure limits, current date, time, etc., stored within the computer memory. The F5 key, when pressed, resets the display back to the default screen and stops the strobe light from flashing. The F6 key is pressed to gain access for adjusting the data displayed on the screen, such as the date, time, set points, etc. This key can be pressed several times to scroll the display to the desired information. The up and down keys are used to actually change the date, time, set points, etc., displayed on the screen.

In operation, and by way of example, when the F5 key is pressed, the default screen will appear on the display. By sequentially pressing the up key 86, the default screen scrolls to display the following parameters: 1) current date; 2) current time; 3) the number of times the compactor has been used since the container was last pulled; 4) the average pressure $P_A$ in the container (as measured by the hydraulic pressure transducer) during the last ten compactor uses; 5) the pressure $P_L$ in the container during the last compactor use; 6) the average compactor usage per pull $U_{PA}$; 7) the percentage of occupied container space, which is reflective of the pressure percentage as determined by $P_A \div P_M$; 8) the percentage of unused container space; 9) the number of compactor uses left $U_R$; and 10–16) the number of uses $U_{TP}$ for each day of the week, respectively. These parameters can also be accessed in reverse order by pressing the down key 88.

When the F2 key is pressed, the Event and Fault Log is displayed. By pressing the up or down keys, the last 10 events that have been recorded in the management unit 70 will be displayed sequentially. Although ten events are preferred, it will be understood that more or less events can be displayed. The Event and Fault Log is useful in determining if and where a malfunction has occurred during operation. Some of the events that can be displayed are: 1) motor overload, which is detected the first time that the hydraulic motor (not shown) on the compactor and is reflective of blown overload heaters on the starter (not shown) when an attempt has been made to start the hydraulic motor; 2) over average pressure, which tells the user that the preset maximum limit $P_M$ has been exceeded; and 3) over-usage goal, which informs the user of the number of compactor usages that exceed the preset usage set point. The preset usage set point can be entered and periodically changed so as to reflect the average usage $U_A$ over several container dumping cycles.

When the F3 key is pressed, the Container Pulled Record Log will appear on the display. Again, by pressing the up and down keys, the date, average compactor pressure $P_A$, and the number of compactor uses for each of the last ten pulls will be sequentially displayed.

Certain predetermined set points and limits, as described above, and other information can be entered by a user or technician once the security code has been properly entered. The information that can be changed includes: 1) the maximum pressure $P_M$ or upper limit at which the particular compactor can operate; 2) the current month and year; 3) the current date and hour; 4) the current day and minute; 5) the usage alarm set point, which is the estimated number of times that the compactor should be used during a predetermined time interval, such as a single day or between container pulls. When this number is exceeded during the time interval, the warning light will flash and the display will show the amount of over-usage; 6) the average upper pressure alarm, i.e. when the average pressure $P_A$ on the compactor reaches the upper set point $P_M$, the average pressure will be shown on the display and the warning light will flash; 7) the last extend time (in seconds) for the compactor ram, which is the time measured between actuation of the hydraulic pump and a predetermined pressure in the hydraulic lines or the tripping of an extend limit switch in the compactor, and the last retract time (in seconds) for the compactor ram, which is the time measured between reversal of the compactor ram direction and the tripping of a retract limit switch in the compactor; 8) the retract fault time, which in the preferred embodiment is set at ten seconds longer than the last retract time; 9) the extend fault time, which in the preferred embodiment is set at ten seconds longer than the last extend time; 10) the extend cut-off time, which in the preferred embodiment is set at one second below the last extend time; 11) the upper pull set point $P_{UP}$, which is the pressure set point above which the compactor must rise in order to initiate the resetting of certain parameters once it is determined that the container has been pulled, as described above; 12) the minimum usage set point $U_M$, which is used in combination with the upper pull set point $P_{UP}$ to reset the certain parameters and dictates the minimum number of times that the compactor must be used before the container has been pulled, as described above; and 13) the lower pull set point $P_{LP}$, which, as described above, dictates the minimum average pressure below which the compactor must fall in order to signal that the container may have been dumped.

The monitoring of extend and retract times of the compactor ram, as described above, is important in determining if the compactor is working properly. A delay in the extend and/or retract times may indicate that the guide shoes on the outside of the ram are worn and should be replaced, or that there is some other problem that is delaying the ram during extension or retraction. Likewise, the extend cut-off time should not be set at a value that is much less than the last extend time, since some compactors rely on the maximum pressure $P_M$ to reverse the ram on every stroke. Thus, only the data relating to the working pressure of the compactor is collected. Even if the compactor is operated without adding additional waste material to the container, the ram extend time is normally not greater than the previous extend time.

Although the display of various parameters has been described in particular detail with respect to the local unit 70 of FIGS. 4 and 5, it is to be understood that such parameters can also be displayed (and changed where appropriate) on a display that is remote from the compactor, such as at the remote computer. All of the information, or different combinations thereof, can be displayed and/or printed simultaneously at the remote location.

As described above, the local display module 74 and warning light 78 can be accessed by the remote computer to let the end user know that service has been arranged at a particular time and/or date, such as when the container is projected to be full, or during compactor malfunction. It has been found that many end users prefer not to be preoccupied with operation of the compactor until the time approaches to pull the container. For this purpose, the warning light 78 can be actuated either from the remote location or locally to notify a user that the container is almost fill, container dumping has been scheduled, compactor service has been ordered, a malfunction in compactor operation has occurred, any of the preset limits as described above has been exceeded, or any combination of the above. When the warning light is flashing, the user can quickly ascertain the particular function or functions that caused the light to flash by pushing the appropriate keys on the keypad. In this manner, the end user has as much control as desired over the compactor and container operation.

Reasonable variation and modification are possible within the spirit of the foregoing specification and drawings without departing from the scope of the invention.

The embodiments for which an exclusive property or privilege is claimed are defined as follows:

1. A method of determining the fill condition of a refuse container to which a compactor is attached for compacting the refuse, the method including the steps of:

measuring at least one pressure applied to the container by the compactor during at least one compression performed by the compactor; and calculating a first-pressure percentage with a processor by dividing the measured pressure by a predetermined pressure limit, the first pressure percentage being reflective of the used space of the refuse container, characterized by:

calculating a second pressure percentage with the processor by subtracting the first pressure percentage from unity, wherein the second pressure percentage is reflective of the amount of space available in the refuse container for holding more refuse.

2. The method according to claim 1, wherein the step of measuring at least one pressure includes measuring a plurality of pressures during a corresponding plurality of compactor operations, and further comprising the step of determining an average pressure from the plurality of pressures, and wherein the step of calculating the first pressure percentage includes dividing the average pressure by the predetermined pressure limit.

3. The method according to claim 2, further comprising the steps of:

determining a first usage count of the compactor during a pull interval between an empty container condition and a full container condition when the container is pulled for dumping by monitoring how often the compactor is actuated to compact the waste during the pull internal; and determining a remaining usage count of the compactor by multiplying the second pressure percentage by the first usage count.

4. The method according to claim 3, further comprising the steps of:

determining a plurality of second usage counts of the compactor for a corresponding plurality of sequential time intervals; and forecasting a time when the container will be full with the processor by comparing the remaining usage count with at least one of the second usage counts.

5. The method according to claim 4, wherein the first usage count is an average first usage count taken over a plurality of pull intervals; and wherein the plurality of sequential time intervals defines a time group; and wherein each of the second usage counts is an average second usage count taken over a plurality of time groups.

6. The method according to claim 5, wherein each time interval is a day and each time group is a week.

7. The method according to claim 5, wherein each time interval is an hour and each time group is a work shift.

8. The method according to claim 1, wherein the predetermined pressure limit is the maximum pressure applied by the compactor when the container is full.

9. A method for detecting when a refuse container has been replaced in a refuse management system having a refuse container associated with a compactor for compacting refuse in the container, the method comprising the steps of:

operating the compactor to compact refuse in the container;

measuring a plurality of pressures applied to the container by the compactor during a plurality of corresponding compactor operations;

calculating an average pressure for the plurality of measured pressures with a processor;

comparing the average pressure with a low pressure set point with the processor; and determining with the processor that the container has been replaced if the average pressure is below the low pressure set point.

10. The method according to claim 9, further comprising comparing compactor usage with a minimum usage set point with the processor; and wherein the determining step includes determining that the container has been replaced if the compactor usage is above the minimum usage set point.

11. The method according to claim 10, wherein the refuse management system comprises a proximity sensor for sensing the presence of the container; and further comprising the step of sensing the container presence with the proximity sensor before measuring the plurality of compactor pressures.

12. The method according to claim 9, wherein the refuse management system comprises a proximity sensor for sensing the presence of the container; and further comprising the step of sensing the container presence with the proximity sensor before sensing the plurality of compactor pressures.

13. A method for predicting when a refuse container will be full, the refuse container being attached to a compactor that compacts the refuse contained in the container, said method including the steps of:

monitoring when the compactor is actuated so as to maintain a count for at least one time interval of the number of times the compactor is used in that at least one time interval;

calculating the average usage of the compactor with a processor for the at least one time interval, said average usage calculation based on the count obtained of how often the compactor was used during a plurality of different ones of the at least one time interval;

determining the fullness of the refuse container with the processor;

calculate the remaining uses of the refuse container based on the fullness of the refuse container with the processor; and determining when the refuse container will be full with the processor by subtracting from the calculated remaining uses of the container the calculated average usage of the refuse container from the current time interval for consecutive time intervals thereafter until the calculated remaining uses falls to zero, the time interval in which the remaining uses falls to zero being the time interval at which the refuse container is predicted to be full.

14. The method of predicting when a refuse container will be full of claim 13, wherein said step of determining refuse container fullness is performed by monitoring the pressure of the compactor.

15. The method of predicting when a refuse container will be full of claim 14, wherein said step of determining refuse container fullness is performed by comparing the pressure of the compactor to a maximum compactor pressure.

16. The method of predicting when a refuse container will be full of claims 15, wherein said step of determining the remaining uses of the refuse container includes: determining the average number of uses of the container over a plurality of pull intervals, each pull interval being an interval between when the refuse container is empty and when the refuse container is full and determining the remaining uses based on the average number of uses of the refuse container and the current measure of waste container fullness.

17. The method of predicting when a refuse container will be full of claim 13, wherein said step of determining waste container fullness is performed by monitoring the pressure of the compactor and determining the average pressure of the compactor over a plurality of uses.

18. The method of predicting when a refuse container will be full of claim 17, wherein said step of determining refuse container fullness is performed by comparing the average pressure of the compactor to a maximum compactor pressure.

19. The method of predicting when a refuse container will be full of claims 17, wherein said step of determining the remaining uses of the refuse container includes: determining the average number of uses of the container and determining the remaining uses based on the average number of uses of the refuse container and the current measure of waste container fullness.

20. The method of predicting when a refuse container will be full of claim 13, wherein said step of determining the remaining uses of the refuse container comprises the steps of:

determining an average number of uses for the refuse container over a plurality of pull intervals, each pull interval being an interval between, when the refuse container is empty and when the refuse container is full; and basing the determination of the remaining uses of the refuse container on said determination of refuse container fullness and said average number of uses for the refuse container.

21. The method of predicting when a refuse container will be full of claim 13, wherein the average uses of the compactor are calculated for a plurality of different, chronologically consecutive time intervals.

22. The method of predicting when a refuse container will be full of claim 21, wherein the time intervals are one from the group consisting of: days; hours; and work shifts.

* * * * *